US005782342A

United States Patent [19]

Hewitt et al.

[11] Patent Number: 5,782,342

[45] Date of Patent: Jul. 21, 1998

[54] APPARATUS AND METHOD FOR LIGHT SWITCH OPERATION

[76] Inventors: Leslie N. Hewitt; Roy B. Hewitt, both of 6828 Wagon Oak Rd., Charlotte, N.C. 28212

[21] Appl. No.: 743,963

[22] Filed: Nov. 5, 1996

[51] Int. Cl.[6] ..... H01H 3/20

[52] U.S. Cl. ..... 200/331; 200/330

[58] Field of Search ..... 200/331, 330, 200/328, 43.14; 16/115, 111 R, 112, 114 R, 125, 126, 127

[56] References Cited

U.S. PATENT DOCUMENTS

| | | | |
|---|---|---|---|
| 2,726,303 | 12/1955 | Berndsen | 200/331 |
| 3,175,420 | 3/1965 | Craig | 200/331 |
| 3,339,051 | 8/1967 | De Vall | 200/331 |
| 3,581,037 | 5/1971 | Schiffelbein | 200/331 |
| 4,567,337 | 1/1986 | Woods, I et al. | 200/331 |
| 5,498,845 | 3/1996 | Browning | 200/330 |

*Primary Examiner*—David J. Walczak
*Attorney, Agent, or Firm*—American Innovations, Inc.; Dorothy Morse, Esq.

[57] ABSTRACT

An improved light switch assembly and a method for its use, wherein the improvement comprises an extension comprising a rod attached on one of its ends to a ring, with the ring being suspended from a hole formed near the end of the lever component of a conventional toggle-type light switch assembly. Applications may include, but are not limited to, use by children for autonomous use of toggle-type light switches, use by an elderly or infirm person who has fallen to signal for help by blinking the light associated with the switch, and use by people restricted to wheelchairs to avoid the expense of lowering electrical switches in a home to a position within their reach.

12 Claims, 1 Drawing Sheet

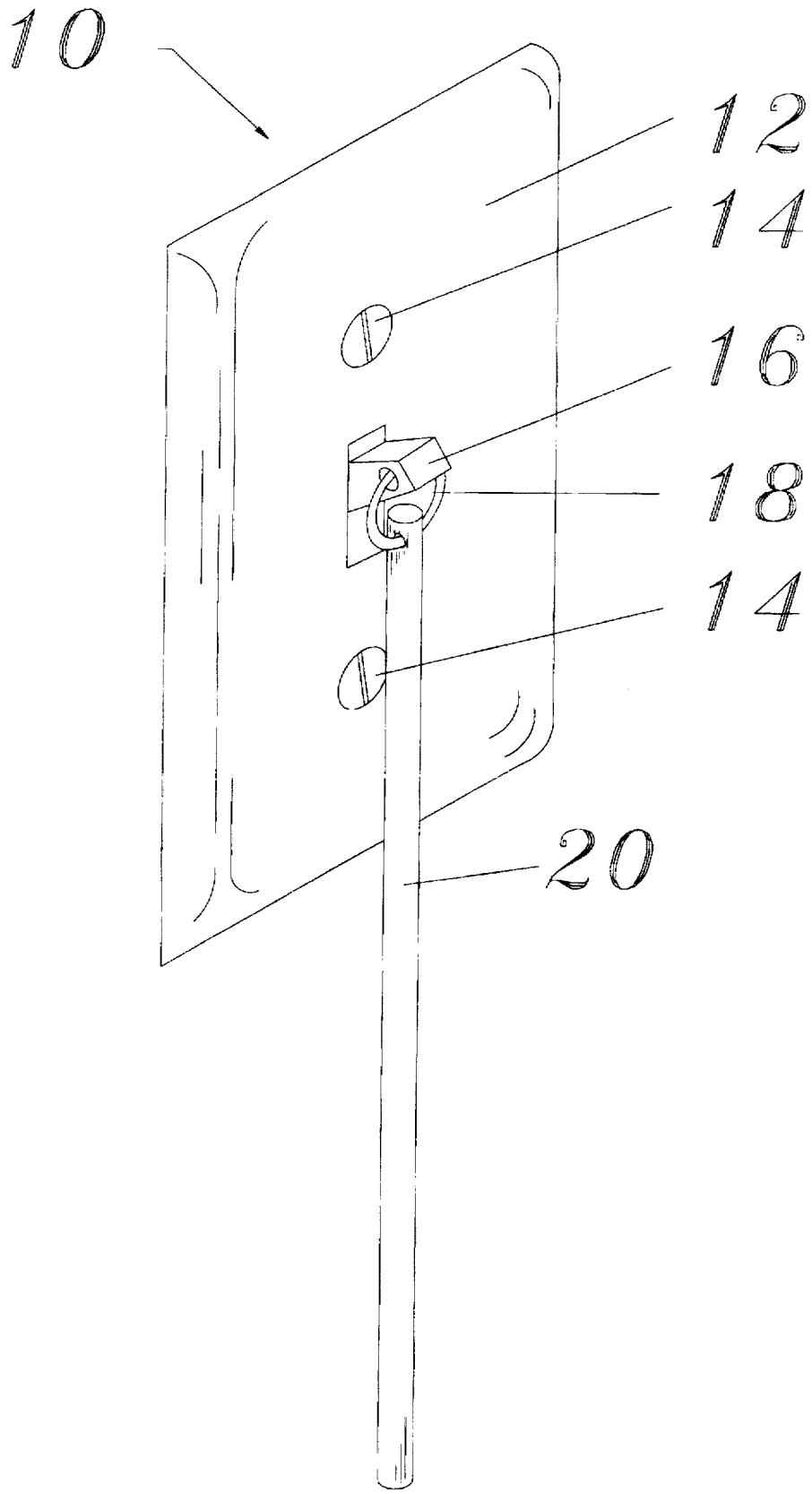
10
12
14
16
18
14
20

APPARATUS AND METHOD FOR LIGHT SWITCH OPERATION

BACKGROUND

1. Field of Invention

This invention relates to toggle-type light switch assemblies and light switch extensions, specifically to an improved toggle-type light switch assembly and a method for its use, wherein the improvement comprises a rod attached on one of its ends to a ring, with the ring being suspended from a hole formed near the distal end of the lever component of the toggle-type light switch assembly. Applications may include, but are not limited to, use by children for autonomous use of toggle-type light switches assemblies, use by an elderly or infirm person who has fallen to signal for help by blinking the light source connected to the toggle-type light switch assembly, and use by people restricted to wheelchairs to avoid the expense of lowering electrical light switches in a home to a position within their reach.

2. Description of Prior Art

Many types of light switch assembly and light switch extension combinations have been created and used. Some extension apparatus requires the use of a replacement cover plate for the light switch to which it will attach. Examples of such light switch extensions are disclosed in U.S. Pat. No. 4,454,401 to Powis, Jr. (1984) which comprises a lever which slides on a replacement cover plate, U.S. Pat. No. 4,590,345 to Marshell (1986) which comprises a replacement cover switch having an elongate slot for receipt of its switch operating rod, U.S. Pat. No. 4,562,325 to De Rouen (1985) which comprises a decorative cover plate which is rotated around a pivot screw for turning the light switch on and off, U.S. Pat. No. 4,745,243 to Wang (1988) which comprises a decorative replacement cover plate having movable elements thereon which shift position as the light switch is turned on and off, and U.S. Pat. No. 5,393,946 to DeLaHoz (1995) which comprises a cover plate having raised guide areas on the left and right of a middle opening for engagement with wing-like projections on one end of an elongated member. In contrast, the present invention is simpler in design as it does not require a replacement cover plate.

The prior art most thought to be most closely related to the present invention are the light switch extensions which disclose a rod connected to a light switch engaging assembly which surrounds the lever component of the light switch as it moves it between on and off positions. Examples of such light switch extensions are disclosed in U.S. Pat. No. 4,705,924 to Hevoyan (1987), U.S. Pat. No. 5,498,845 to Browning (1996), U.S. Pat. No. 5,017,746 to Guimarin (1991), U.S. Pat. No. 5,380,967 to Steen (1995), and U.S. Pat. No. 5,396,037 to Moore (1995). The Hevoyan invention comprises a guide with laterally upturned flanges being permanently secured to the lower attachment hole in a cover plate for a toggle-type light switch. In addition, the Hevoyan invention comprises a flattened elongated member having a flexible planar member attached to one of its ends. During use to turn on and off the light switch lever, the flexible planar member is slidingly fixed to the cover plate by the upturned flanges on the guide and an opening in its distal end is positioned around the lever for push-pull operation. In contrast, the present invention is simpler in design, not requiring a flanged guide. The Browning invention comprises a flattened elongated member with an opening adjacent to one of its ends. Use of the Browning invention involves push-pull operation with the opening positioned around the lever on a toggle-type light switch. One disadvantage of the Browning invention is that young children, as well as injured adults who have fallen, may not have the coordination to connect the small opening around the light switch lever for its use, and if the opening is made larger for easier connection, the Browning invention would be more likely to slip off the light switch lever during use. The ring in the present invention connecting the rod to the light switch lever overcomes this disadvantage.

Further, the Guimarin invention comprises a rigid elongate arm connected to a switch-contacting member. A flexible strap member is attached over the switchcontacting member between the two screw holes in a conventional light switch cover plate. When so connected, the strap member assumes a bowed out configuration over the lever of the toggle-type light switch to hold it captive during use. In contrast, he present invention is simpler in design an less expensive to manufacture. The Steen invention comprises an elongated arm having an opening near one end for receipt of a toggle-type or rocker-type light switch lever. The other end of the Steen invention has a pin projecting outwardly therefrom. The elongated arm is slidably engaged with two guiding members which allow upward and downward sliding of the arm to move the lever between on and off positions. The present invention is also simpler in design than the Steen invention and less expensive to manufacture. The Moore invention comprises and elongate rod with a damp structure attached to one end for positioning around the lever of a toggle-type light switch. A handle attached to the other end of the Moore invention comprises illumination means to indicate the position of the rod for use in the dark. The present invention is simpler in design than the Steen invention and would be less expensive to manufacture. It is not known in this field to have an improved light switch assembly comprising an elongate rod attached on one of its ends to a ring and the ring being suspended from a hole formed near the end of the lever component of a toggle-type light switch.

SUMMARY OF INVENTION—OBJECTS AND ADVANTAGES

It is the primary object of this invention to provide an improved light switch assembly which would be conventionally positioned on a wall and have an extension to allow children, persons who have fallen and are injured, and people using wheelchairs autonomous access to the light sources connected thereto. It is also an object of this invention to provide an improved light switch assembly which is simple to use. A further object of this invention is to provide an improved light switch assembly which is inexpensive to manufacture. It is also an object of this invention to provide an improved light switch assembly which quickly and effectively performs its intended function.

As described herein, properly manufactured, and with an extension connected to a conventional toggle-type light switch having a lever with a hole near its distal end, the present invention would provide a quick and easy means of turning on and off light sources connected to the lever. A ring attached to the end of the elongated actuating rod would also be inserted through the hole made near the distal end of the lever. Thereby, as the rod is lifted, the ring upwardly lifts the lever to turn on connected light sources, and as the rod is lowered, the ring lowers the attached lever to turn the light sources off. Since the rod is attached to the lever by the ring, the person using the present invention will not be required to have the level of coordination necessary for connecting a small opening around the small light switch lever prior to use. Also, the present invention has only two relatively simple components, making it inexpensive to manufacture and use. It is contemplated for the improved light switch assembly to be installed in new construction, as well as being retrofitted into existing buildings. It is also contemplated for the rods and rings to be made from decorative colors and detachable from the distal end of the lever so that new rods and rings can be installed to match new decor.

The description herein provides preferred embodiments of the present invention but should not be construed as limiting the scope of the improved light switch assembly invention. For example, variations in the materials from which the ring is made, the thickness and diameter of the ring, the diameter of the elongated rod, the length of the rod, and the materials from which the rod is made, other than those shown and described herein, may be incorporated into the present invention. Thus the scope of the present invention should be determined by the appended claims and their legal equivalents, rather than the examples given.

BRIEF DESCRIPTION OF THE DRAWINGS

The sole draping provided in this application is a perspective view of the invention.

DETAILED DESCRIPTION OF PREFERRED EMBODIMENTS

The sole drawing shows an improved light switch assembly 10 comprising a rod 20 having an aperture through one of its ends and a ring 18 connected through the aperture. The sole drawing also shows ring 18 connected through a hole near the end of a conventional light switch lever 16. Screws 14 are shown secured through the face of a conventional cover plate 12 to secure cover plate 12 to a surface (not shown) rearward therefrom. Cover plate 12 is also shown to have a rectangular slot through which light switch lever 16 protrudes outwardly. Although the materials used to make ring 18 and rod 20 are not critical to the present invention, in the preferred embodiment it is contemplated for rod 20 to comprise wood or plastic materials, and for ring 18 to comprise metallic material. Rod 20 can be made from colored materials so as to be decorative and can also be made from materials which glow in the dark for use in easily locating its position at night. It is critical for both ring 18 and rod 20 to be sufficiently rigid for easy upward lifting of light switch lever 16 when a user (not shown) sufficiently raises rod 20 in an upward direction. Also, the diameter of ring 18 is not critical to light switch extension 10, nor is the thickness of the material from which it is made, as long as both the diameter and thickness are dimensioned to be sufficiently durable for long term use. Also, although the length of rod 20 is not critical, in the preferred embodiment it is contemplated for rod 20 to be approximately twenty-four inches in length. In the preferred embodiment, ring 18 comprises the type of ring commonly used for key chains so that ring 18 and rod 20 are removable from light switch lever 16, and rod 20 comprises a rod similar to that typically used to operate window blinds so that a person's hands, feet, or mouth can be used to easily operate it.

It is contemplated for improved light switch assembly 10 to be installed into new construction or its extension portion, to include its rod and its ring, to be retrofitted onto existing light switch assemblies. To use improved light switch assembly 10, a hole must be drilled near the distal end of light switch lever 16. The orientation and position of the hole within the end of light switch lever 16 is not critical, however, in the preferred embodiment the hole is drilled horizontally therethrough. An aperture must also be drilled near to one end of rod 20. Ring 18 is then inserted into both the hole in light switch lever 16 and the aperture in rod 20. As rod 20 is raised to lift ring 18, light switch lever 16 is also lifted to turn on an associated light, and when rod 20 is lowered to bring down ring 18, light switch lever 16 is also lowered to turn off an associated light.

What is claimed is:

1. An improved light switch assembly comprising a conventional light switch assembly having a toggle-type lever, wherein the improvement comprises a light switch extension comprising:

an elongate rod and a ring member, said rod having an aperture therethrough adjacent to one of its ends and being sufficiently rigid to push against said toggle-type lever to raise it into an upward position;

said ring member connected through said aperture, said ring member also being sufficiently rigid to raise said toggle-type lever into an upward position and being connected directly through a hole through the distal end of said toggle-type lever so that a portion of said toggle-type lever is positioned within an aperture of said ring member wherein upward movement of said rod raises said ring which raises said toggle-type lever into an upward position, lowering of said rod lowers said ring which causes said toggle-type lever to be lowered, and so that a twisting motion exerted on said rod will not cause said ring member to be disconnected from said distal end of said toggle switch.

2. The improved assembly of claim 1 wherein said rod has a length dimension of approximately twenty-four inches.

3. The improved assembly of claim 1 wherein said ring is configured for secure connection to said toggle-type lever, as well as easy connection to and removal from said toggle-type lever when needed.

4. The improved assembly of claim 3 wherein said ring comprises a conventional keychain-type of ring.

5. The improved assembly of claim 1 wherein said rod has a length dimension of approximately twenty-four inches and wherein said ring comprises a conventional type of keychain ring for secure connection of said ring to said toggle-type lever, as well as easy connection to and removal from said toggle-type lever when needed.

6. The improved assembly of claim 5 wherein said rod comprises materials which glow in the dark for enhanced visibility by a user.

7. A method for remote operation of a conventional light switch assembly having a toggle-type lever, said method comprising the steps of providing conventional light switch assembly having a toggle-type lever, a rod, a ring, and a drill; using said drill to make a hole through said toggle-type lever near to its distal end; using said drill to make an aperture through said rod near to one of its ends; placing said ring through said hole; also placing said ring through said aperture so that when said rod is lifted said ring is also lifted which raises said toggle-type lever to activate a light source associated thereto, and when said rod is lowered said ring is also lowered which lowers said toggle-type lever to turn off said light source.

8. The method of claim 7 wherein said provided rod has a length dimension of approximately twenty-four inches.

9. The method of claim 7 wherein said provided ring is configured for secure connection to said toggle-type lever, as well as easy connection to and removal from said toggle-type lever when needed.

10. The method of claim 9 wherein said provided ring comprises a conventional keychain-type of ring.

11. The method of claim 7 wherein said provided rod has a length dimension of approximately twenty-four inches and wherein said provided ring comprises a conventional type of keychain ring for secure connection of said ring to said toggle-type lever, as well as easy connection to and removal from said toggle-type lever when needed.

12. The method of claim 11 wherein said provided rod comprises materials which glow in the dark for enhanced visibility by a user.

* * * * *